United States Patent [19]

Rivkin

[11] Patent Number: 4,632,397

[45] Date of Patent: Dec. 30, 1986

[54] AMUSEMENT CHANCE DEVICE

[75] Inventor: Bernard W. Rivkin, Poway, Calif.

[73] Assignee: P.P.M.D. Inc., Poway, Calif.

[21] Appl. No.: 697,561

[22] Filed: Feb. 1, 1985

[51] Int. Cl.[4] ..... A63F 9/04

[52] U.S. Cl. ..... 273/145 CA; 273/1 L; 273/146

[58] Field of Search ..... 273/145 C, 145 CA, 145 B, 273/146, 1 L

[56] References Cited

U.S. PATENT DOCUMENTS

| | | | |
|---|---|---|---|
| D. 169,744 | 6/1953 | Frost | 273/145 C X |
| 484,115 | 10/1892 | Saxton | 273/145 C |
| 2,237,883 | 4/1941 | Lipic | 273/145 C |
| 4,046,381 | 9/1977 | Comeaux | 273/146 X |
| 4,049,277 | 9/1977 | Carlsson, Jr. et al. | 273/145 C |

FOREIGN PATENT DOCUMENTS

| | | | |
|---|---|---|---|
| 2939802 | 4/1981 | Fed. Rep. of Germany | 273/145 C |
| 3319267 | 11/1984 | Fed. Rep. of Germany | 273/146 |
| 579834 | 8/1924 | France | 273/146 |
| 621488 | 2/1927 | France | 273/146 |
| 1095775 | 12/1954 | France | 273/1 L |
| 2437853 | 6/1980 | France | 273/146 |
| 2536291 | 5/1984 | France | 273/1 L |

*Primary Examiner*—Paul E. Shapiro

[57] ABSTRACT

A transparent container partially filled with transparent viscous liquid; contains a multifaceted multicolored indicia enhanced game piece, which is greater in specific gravity than the transparent viscous liquid and an air bubble greater in size than the maximum horizontal clearance distance between the game piece and container side wall. When the container is turned relatively end for end the bubble rises, striking the game piece, whereby it rotates as it falls slowly to the bottom of the container, where the top or scoring facet of the game piece is viewed through the transparent container and transparent liquid. The game piece falling time period, being relatively repetitive, may be used for game play timing. The colors and indicia on the game piece facets give the player game playing instructions. When two or more containers are used in cooperation or two or more game pieces are used in one container, the colors of the game piece scoring facets instruct the players to either add, subtract or cancel the cooperative game pieces indicia, whereby there is a greatly expanded number of possible combinations. Incorporation of a tumble weight, having points and edges, inside hollow game pieces enhance erratic rotation of the game pieces as they fall adding suspense and avoiding player influence. Magnetic polarization of the game pieces whereby they repel each other, avoids game pieces coming to rest atop each other obscuring the scoring facet. The air bubble accommodates expansion or contraction of the liquid in the container.

9 Claims, 9 Drawing Figures

AMUSEMENT CHANCE DEVICE

BACKGROUND OF THE INVENTION

1. Field of the Invention

The present invention relates to an amusement chance device for the improved presentation of changing value game information.

Another object of the invention is to provide a gaming means which enhances play on presently existing games.

A further object of the invention is to add excitement and suspense to the playing of games involving the use of multi-faceted game pieces.

Another object is to provide a self contained means for gaming piece agitation which reduces influence by the players.

Another object of the invention is to provide a timing means for game play.

An additional object of the invention is to provide a device embodying multicolored indicia inscribed game pieces which may be used in multiples to further interact in game play thus providing greatly expanded chance possibilities.

2. Description of the Prior Art and Summary of the Invention

Liquid filled die agitators of various types are provided in prior art such as U.S. Pat. Nos. 2,452,730, to Carter, 4,049,277 to Carlson, 4,176,469 to Timco. Such agitators usually consist of a container filled with opaque liquid, free of air bubbles and a die which displaces a greater mass than its own mass causing the die to rise or float. In the execution of these systems, it has been the object to create a liquid chamber which is free of air bubbles since the air bubble would rise along with the die and cause distraction and mal performance. The manufacture of such devices is complex, some times requiring filling and capping while the container is immersed in the filling liquid to avoid air inclusion. U.S. Pat. No. 4,049,277 teaches the use of two chambers. The first, containing the gaming piece, is maintained air free and the second chamber contains overflow liquid and air to provide for an expansion and contraction of the liquid responding to environmental changes. U.S. Pat. No. 4,176,469 provides a flexible diaphragm to accomplish this function. The instant invention eliminates the need for the care and costs of manufacturing air free die chambers while still allowing for liquid expansion and contraction and non-critical liquid filling methods. Another advantage of this invention is elimination of the need for internal obstacles as cited in U.S. Pat. No. 2,452,730 simplifying manufacture and filling requirements. Further benefit of the invention is gained by dividing the colors of the multi-faceted game pieces into two or more groups, one group, typically colored green, to represent plus or forward movement and one group, typically colored red, to represent minus or backward movement, whereby providing additional suspense and excitement while the game piece is being agitated until it comes slowly to rest at the bottom of the chance column. A feature which may be incorporated in the invention is the use of a game piece with a hollow interior and including a specially shaped tumble weight having points and edges. The use of a hollowed die and a round ball bearing is shown in U.S. Pat. No. 4,176,469. Another feature which may be added to the invention, is the use of positively polarized magnetic game pieces whereby when two or more game pieces are used within the same container, the game pieces repel each other and avoid stacking. Another embodiment of the invention includes the use of a mechanical turning means to further eliminate player influence on scoring results by providing relatively consistent turning action.

An alternate embodiment of the device includes external, movable, negatively polarized, magnetic sources, at each end of the chance column, whereby the fallen positively magnetically polarized game piece is captured in a magnetic force field. The change column may then be turned relatively end for end and the external magnetic source holds the magnetic game piece until the magnetic source is moved away, breaking the force field whereby the game piece falls by gravity to the bottom of the container. This embodiment enhances the use of the chance column configuration as a timing means.

DESCRIPTION OF THE DRAWINGS

In accordance with the aspects of this invention for a chance device a preferred embodiment is shown in FIGS. 1 thru 9 wherein.

DETAILED DESCRIPTION OF THE INVENTION

Figure 1:
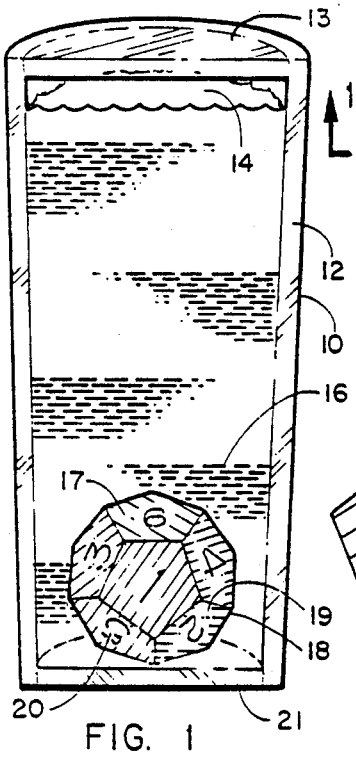
FIG. 1 shows an elevational view, in section and perspective of the assembled chance column, shown across lines 1—1 of FIG. 2.
Figure 2:
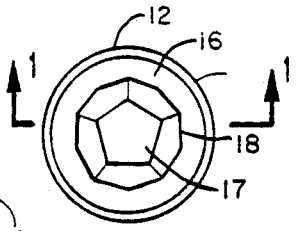
FIG. 2 shows a plan view of a chance column.
Figure 3:
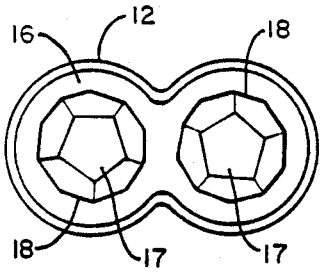
FIG. 3 shows a plan view of an oval dual game piece chance column.
Figure 4:
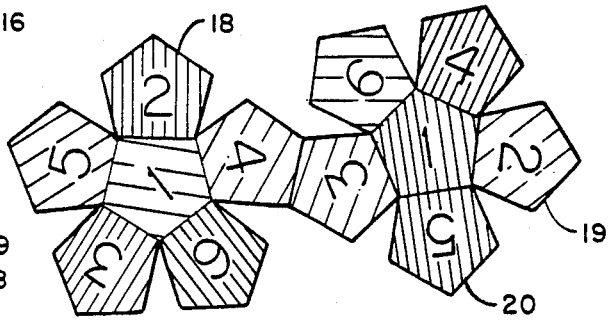
FIG. 4 is an exploded view of the multi-faceted game piece showing a typical color and number pattern.
Figure 5:
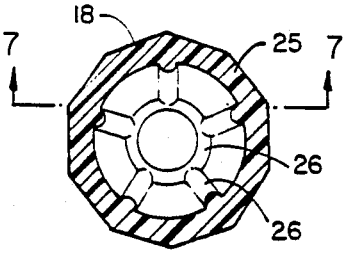
FIG. 5 shows a cross section of a multi-faceted game piece, interior view, showing the hollow area and raised segmenting ribs.
Figure 6:
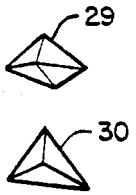
FIG. 6 shows two shapes of weights suitable for inclusion within the multi-faceted game piece.
Figure 7:
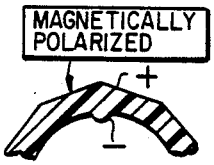
FIG. 7 shows a top view of a typical bridge to juxtapose two chance columns creating a single chance device.
Figure 8:
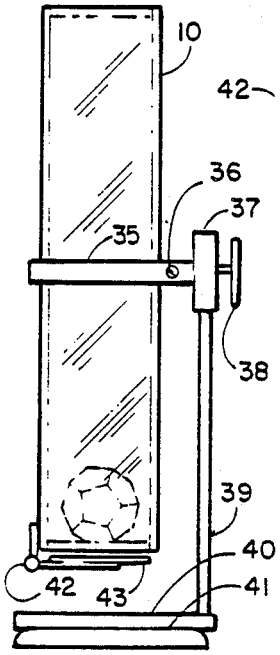
FIG. 8 shows a cross section along 8—8 of FIG. 7.
Figure 9:
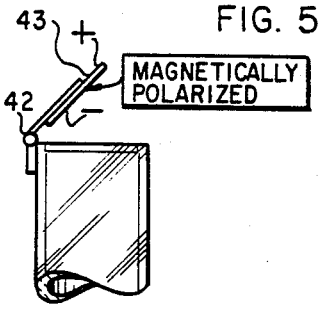
FIG. 9 shows a side view of a mechanical turning means for rotating the chance column, with an external hinged magnetic source.

Referring to the drawings in detail and initially FIG. 1 thereof; shows an embodiment of a chance column 10 consisting of a transparent container 12, with end caps 13 and 21, partially filled with a transparent viscous liquid 16, and air/or gas bubble 14, and a multi-faceted chance piece 18, whereupon the various multi-colored facets such as 19 and 20, have indicia inscribed. The scoring surface 17 is viewed through the transparent liquid in the transparent container. FIG. 2 is a plan view of a chance column with single game piece. FIG. 3 is a plan view of an oval game chance column with two game pieces. FIG. 4 is an exploded view of a chance piece 18 showing the multi-colored factes such as 19, lined for color green and 20, lined for color red, with indicia thereon in a typical pattern. In this pattern forward and backward or plus and minus indicia is placed on diametrically opposed facets so that if "one" forward is shown on the scoring surface 17 "one" backward is obscured on the underside of the chance piece. FIG. 5 is a cross section of a dodecahedron chance piece 18 showing the hollow inside with the raised segmenting ribs 26, and a joining ledge 25. FIG. 6 illustrates two types of eccentric weights, 29 an octahedron and 30 a tetrahedron, either being suitable for inclusion within the chance piece. FIG. 7 is a top view of a bridge 31 used to juxtapose two chance columns and form a multiple column chance device. FIG. 8 is a cross section of FIG. 7 at B—B showing the two receiver wells 32 and 33 created in bridge 31 to accept two chance columns. FIG. 9 is a side view of a mechanical turning means wherein chance column 10 is held by collar 25 tensioned by screw 36 said collar is connected to turning means 37. Turning means 37 is affixed to base 40 by column 39. Suction cup 41 is attached to the bottom of base 40. External magnetic source 43 is movably affixed to chance column 10 by hinge 42.

In conformity with the intent of this chance device invention one or more transparent containers are provided and partially filled with a transparent viscous liquid; one or more multi-faceted, multi-colored, indicia enhanced game pieces, preferably in a pentagonal dodecahedron form substantially greater in specific gravity than the transparent liquid, are immersed in the liquid and the containers are closed allowing a controlled air/or gas bubble to be entrapped.

The game piece is preferably injection molded in two parts using multi-cavity molds. After the molding cycle the pieces are retained attached to the sprue and in that form are hot stamped for coloring and numbering, magnetically polarized, then the weights are inserted, the two halves joined together with solvent along the joining ledge and the assembled game pieces separated from the sprue. The molding material of choice is polyester with glass fiber which can have a specific gravity of 2.3.

Tumble weights for inclusion within game pieces can be cast using metal having a high specific gravity in irregular shapes providing points and/or edges designed to catch the raised segmenting ribs molded around the walls of the hollow area whereby providing eccentric rotation of the game piece while falling.

When two or more game pieces are used within one container it is preferred that the game pieces are made of magnetic material positively polarized on the outer surface. Magnetic polarization of the game pieces may be obtained by using special molding materials. Positively polarized game pieces will repel each other whereby game pieces will not come to rest atop each other obscuring the scoring surface. Separation of the game pieces may also be accomplished using a Cassini Oval shaped container or a vertically partitioned container.

The viscous transparent liquid may be a combination of water and glycerine or oil. Since the fall rate of the game piece is dependent on a combination of factors, including: liquid viscosity, specific gravity of the game piece, shape of the game piece (as regards flow motion through the liquid), constriction of the liquid between container sides and the game piece, the combination can be controlled whereby the fall rate needed to provide optimum suspense time, a relatively repetitive timing period, and desired number of rotations wanted to avoid player influence is provided. The viscosity of the liquid helps keep it relatively bubble free. Since the scoring surface is viewed through the transparent viscous liquid at the bottom of the column, the air/or gas bubble at the top is not an interference or distraction. When the column is turned relatively end for end, either manually or with a turning means, the bubble rises and strikes the game piece causing an uncontrolled tumble action to begin.

The tumble action of the game piece can be further enhanced by use of an enclosed eccentric weight striking the internal raised segmenting ribs, causing erratic rotation.

The manner of use of the turning means is as follows; the chance column is installed in the collar, the suction cup is attached to a flat surface, the means is actuated whereby the collar rotates causing the chance column to rotate relatively end for end and the game piece to fall due to gravity.

A dodecahedron shaped game piece is preferred because it provides several basic advantages; one, most games of chance using game pieces have six sided cubes which are numbered one thru six, therefore, since only the top facet or scoring surface of the dodecahedron shows when it is at rest, the duplication of numbers causes more suspense as it tumbles without player control; two, the shape of the dodecahedron lends itself to tumbling in liquid since it offers less obstruction and the viscous liquid flows more easily around the eased facets allowing more rotations in a given container length.

Though the column with a multi-faceted game piece bearing forward and backward indicia, greatly enhances play in most games, and the forward and backward indicia may be provided in various ratios, the combination of two or more containers or two or more game pieces within one container in cooperation, geometrically increases game playing possibilities by providing an add, subtract and cancel feature. To illustrate the subtract feature; if one game piece shows 6 positive or forward and another shows 3 negative or backward, the player would net 3 places forward or positive. To illustrate the add feature; if one game piece shows 5 negative and the other game piece shows 6 negative, the total result would be 11 negative or 11 backward steps. An illustration of the cancel feature; where game piece "one" shows number 4 green and game piece "two" shows number 4 red, the net result is 0 or cancel. Therefore, using one game piece, which is a dodecahedron numbered 1 thru 6 in red and 1 thru 6 in green, the throw could result in any one of twelve possibilities. By adding a second game piece, the effect of add, subtract and cancel is 1 of 288 potential results, or 24 times the number of possibilities. Plus and minus, or other arithmetic supplements are shown in prior art such as U.S. Pat. No. 3,892,410 to Hoetzel and U.S. Pat. No. 4,431,194 to Lapadura. U.S. Pat. No. 3,892,410 teaches the use of multi-sided game pieces bearing numbers on each face which are included in a set of spheres and shakers, the game pieces are agitated by removal of a platform bearing an arithmetic instruction, such as add, subtract, etc., allowing the game pieces to fall and thereby be agitated. U.S. Pat. No. 3,892,410 teaches the use of three dice in the play of Backgammon wherein two dice are conventionally numbered and the third die incorporates three plus and three minus signs in addition. The special die determines the additional forward or backward moves to be made. When the sum of the three dice are all plus, three moves are made forward by the number of each die. When the minus number on the special die is less or equal to the number on one of the regular dice, subtract from that die only.

It will be seen from the above descriptions and drawings that an amusement chance device has been invented which is extremely effective in providing suspense, greatly enhanced chance possibilities, reduced player control, repetitive timing capability, ease and economy of manufacture and new versatility when used with many present chance controlled games.

Though preferred embodiments of the chance device have been described herein with reference to accompanying drawings, it is to be understood that the invention is not limited to these precise embodiments and changes and modifications may be made by those skilled in the art, without departing from the scope or spirit of this invention.

What is claimed is:

1. An amusement chance device comprising:

(a) a closed, walled, transparent container; defining a hollow chamber;

(b) a transparent viscous liquid substantially filling said chamber including an air bubble greater in size than the distance between the chamber wall and the included game piece;

(c) a multifaceted game piece in said chamber, said game piece having a specific gravity greater than that of the viscous liquid, indicia on the facets;

(d) the size of the game piece being dimensioned relative to the horizontal cross sectional size of the chamber to constrict passage of the fluid between the game piece and the container wall as the game piece falls through the liquid.

2. The device as defined in claim number 1 wherein the game piece has a hollowed out interior having raised segmenting ribs and containing a tumble weight with formations to catch on said ribs.

3. The device as defined in claim 1 wherein the container is in the shape of a Cassini oval with a multifaceted game piece in each chamber, the size of the game pieces being dimensioned relative to the horizontal cross sectional size of the chambers to constrict the passage of the fluid as the game pieces fall and prohibiting contact.

4. The device as defined in claim 1 whereby the combination of fluid viscosity and specific gravity, the shape and specific gravity of the game piece, the size of the game piece selected relative to the cross section of the container to provide constricted fluid passage, an air bubble greater in size than the maximum horizontal clearance distance between the game piece and container walls, said air bubble rising when device is rotated striking the side of the game piece at the constriction area between container wall and game piece commences game piece rotation which continues during free fall the length of the container variably selected cooperatively, to provide a repetitive rotating game piece travel time period, to be used as a game play timing device.

5. An amusement chance device comprising:

(a) a closed walled transparent container defining a hollow chamber;

(b) a transparent viscous liquid substantially filling said chamber;

(c) a multifaceted magnetic game piece in said chamber, said game piece having a specific gravity greater than said liquid, indicia on the facets;

(d) the size of the game piece being dimensioned relative to the horizontal cross sectional size of the chamber to constrict passage of the fluid between the game piece and the container wall as the game piece falls through the liquid;

(e) a magnet attached to at least one of the opposing ends on the outside of the container for holding the game piece against the inner surface of said one container end by magnetic attraction, said magnet being movably mounted whereby it may be moved away from said container end to release said game piece allowing it to fall through said liquid.

6. An amusement chance device comprising:

(a) a closed, walled, transparent container defining a hollow chamber;

(b) a transparent viscous liquid substantially filling said chamber;

(c) a plurality of multifaceted game pieces in said chamber, each of said game pieces having a specific gravity greater than that of the liquid and indicia on its facets;

(d) said game pieces incorporating magnetic material and being polarized to have the same magnetic polarity over their entire exterior surface whereby said game pieces will repel each other to prevent them from stacking one upon another.

7. The device as defined in claim 6 whereby two or more colors on the game pieces have different game instructional meaning directing the player to add, subtract or cancel the scoring results of the game pieces cooperatively.

8. The device as defined in claim 6 whereby the combination of fluid viscosity and specific gravity, the shape and specific gravity of the game pieces, the size of the game pieces relative to the cross section of the container, and the length of the container are selected cooperatively to provide a repetitive game piece travel time period to be used as a game play timing device.

9. The device as defined in claim 6 whereby a magnet is attached to each end of the container on the outside for holding the game piece against the inner surface of the container end by magnetic attraction, said magnets being movably mounted whereby they may be moved away from said container ends to release said game piece allowing it to fall through said liquid.

* * * * *